US010424888B2

(12) United States Patent
Bin

(10) Patent No.: US 10,424,888 B2
(45) Date of Patent: Sep. 24, 2019

(54) POWERED FIXTURE SYSTEM AND INSTALLATION THEREOF

(71) Applicant: CANEL LIGHTING CO., LTD., Taipei (TW)

(72) Inventor: Chou Shih Bin, Taipei (TW)

(73) Assignee: Canel Lighting Co., Ltd., Taipei (TW)

( * ) Notice: Subject to any disclaimer, the term of this patent is extended or adjusted under 35 U.S.C. 154(b) by 0 days.

(21) Appl. No.: 15/656,047

(22) Filed: Jul. 21, 2017

(65) Prior Publication Data

US 2019/0027881 A1 Jan. 24, 2019

(51) Int. Cl.

| | |
|---|---|
| ***H01R 13/58*** | (2006.01) |
| ***H01R 33/06*** | (2006.01) |
| ***F21V 23/06*** | (2006.01) |
| ***F21V 21/02*** | (2006.01) |
| ***H01R 24/78*** | (2011.01) |
| ***H01R 13/73*** | (2006.01) |
| ***F21V 21/04*** | (2006.01) |
| *H01R 103/00* | (2006.01) |

(52) U.S. Cl.

CPC ..... *H01R 33/06* (2013.01); *F21V 21/02* (2013.01); *F21V 21/04* (2013.01); *F21V 23/06* (2013.01); *H01R 13/58* (2013.01); *H01R 13/73* (2013.01); *H01R 24/78* (2013.01); *H01R 2103/00* (2013.01)

(58) Field of Classification Search

CPC . H02G 3/20; F21V 21/02; F21V 23/06; F21V 21/04; F21V 21/03; H01R 13/58; H01R 13/73

See application file for complete search history.

(56) References Cited

U.S. PATENT DOCUMENTS

| | | | | | |
|---|---|---|---|---|---|
| 1,666,223 | A * | 4/1928 | Whitman | H02G 3/20 | 174/54 |
| 1,666,411 | A * | 4/1928 | Olier, Jr. | F21S 8/06 | 362/407 |
| 2,349,924 | A * | 5/1944 | Anderson | H02G 3/20 | 174/61 |
| 2,671,821 | A * | 3/1954 | Zientowski | F21V 21/03 | 174/54 |
| 3,356,840 | A * | 12/1967 | Cohen | F21V 21/03 | 174/54 |
| 4,340,826 | A * | 7/1982 | Muchnick | H01H 9/167 | 307/157 |
| 4,721,480 | A * | 1/1988 | Yung | H01R 13/70 | 416/5 |
| 4,808,071 | A * | 2/1989 | Chau | F04D 25/088 | 416/170 R |
| 5,376,020 | A * | 12/1994 | Jones | F21V 21/03 | 220/812 |
| 5,507,619 | A * | 4/1996 | Ryan | F04D 25/088 | 277/644 |
| 6,799,982 | B2 * | 10/2004 | Kerr, Jr. | F21V 21/02 | 439/140 |

(Continued)

*Primary Examiner* — Felix O Figueroa
(74) *Attorney, Agent, or Firm* — Lieberman & Brandsdorfer, LLC

(57) ABSTRACT

Embodiments relate to a system to support a power a fixture as well as installation thereof. A base enclosure is converted to a power junction container that functions to mechanically support a fixture and to electrical transform an outlet receptacle embedded in the container into an electrical outlet. The power junction container electrically connects a plug of a received fixture into the electrical outlet.

20 Claims, 14 Drawing Sheets

(56) References Cited

U.S. PATENT DOCUMENTS

| | | | | |
|---|---|---|---|---|
| 7,064,269 | B2 * | 6/2006 | Smith | H01R 33/46 174/481 |
| 7,976,338 | B1 * | 7/2011 | Webster | H02G 3/20 362/404 |
| 8,839,511 | B2 * | 9/2014 | Krupa | F21S 8/043 29/854 |
| 8,854,796 | B2 * | 10/2014 | Wilcox | F21S 8/026 174/50 |
| 9,394,919 | B1 * | 7/2016 | Byrne | F04D 29/646 |

* cited by examiner

400

500

900

POWERED FIXTURE SYSTEM AND INSTALLATION THEREOF

BACKGROUND

The present embodiments relate to integrating an outlet for a power receiving fixture. More specifically, the embodiments related to an independent power junction container and use of the container as an independent unit to install the power receiving fixture.

A power receiving fixture, such as a permanent light fixture, is a device that is attached to a wall or ceiling. The fixture, in the form of a light fixture, is an electrical device that uses electrical power to create artificial light. In general, the fixture includes a body and a socket, and in one embodiment, a shade. The socket is configured to receive a light bulb or other lighting element. Upon receipt of energy, the fixture converts the energy into light, and the bulb or other lighting element illuminates an adjacently positioned area. The shade functions to direct the light to a specific area.

Light fixtures come in different shapes, sizes, and forms. The light fixture may be categorized as temporary or permanent. An example of a temporary fixture is a desk, table, or floor lamp. The temporary lamp general includes a pedestal on which the fixture is mounted. The pedestal may be placed on a secondary surface, such as the desk, table, or floor. A power cord and an electrical plug are generally provided as part of the temporary fixture. At such time as the plug is received in an adjacently positioned electrical outlet, energy is delivered to the light bulb, and light is illuminated. The temporary lamp fixture may be transported from one secondary surface to another secondary surface, and as are referred to as temporary fixtures. The permanent light fixture, unlike the temporary light fixture, is usually directly wired into an outlet, and as such is not easily transported or moved. Examples of permanent light fixtures include, but are not limited to, a chandelier, bath light, and sconce. Although the permanent fixture may be moved, electrically disconnecting the fixture from the outlet is challenging and requires effort.

SUMMARY

A method, system and apparatus are provided to structurally support and provide electrical power to a power fixture.

In one aspect, a method is provided for installing the power fixture. A base enclosure is converted into a power junction receptacle, which is in electrical communication with the outlet, including the wire(s) and the ground. The fixture is mechanically attached to the power junction box. In addition, the fixture is grounded to a junction in communication with the power junction box. Thereafter, an electrical plug of the fixture is electrically connected to the power outlet that is integrated into the power junction receptacle.

In another aspect, a system is provided with a base enclosure converted into a power junction container. The conversion includes an attachment of a ground from an outlet to an embedded bracket, an attachment of a wire from the outlet to an outlet, and an attachment of the ground wire to a ground. Attached of the wire(s) creates an embedded outlet in the power junction container. A fixture is mechanically attached to the power junction container. Thereafter, the fixture is electrically attached to the power junction container. The electrical attachment includes an attachment of the ground wire to a junction in communication with the power junction container, and an electrical connection of a fixture plug to the integrated outlet of the power junction container.

These and other features and advantages will become apparent from the following detailed description of the presently preferred embodiment(s), taken in conjunction with the accompanying drawings.

BRIEF DESCRIPTION OF THE SEVERAL VIEWS OF THE DRAWINGS

The drawings referenced herein form a part of the specification. Features shown in the drawings are meant as illustrative of only some embodiments, and not of all embodiments, unless otherwise explicitly indicated.

DETAILED DESCRIPTION

It will be readily understood that the components of the present invention, as generally described and illustrated in the Figures herein, may be arranged and designed in a wide variety of different configurations. Thus, the following detailed description of the embodiments of the apparatus, system, and method of the present invention, as presented in the Figures, is not intended to limit the scope of the invention, as claimed, but is merely representative of selected embodiments of the invention.

Reference throughout this specification to "a select embodiment," "one embodiment," or "an embodiment" means that a particular feature, structure, or characteristic described in connection with the embodiment is included in at least one embodiment of the present invention. Thus, appearances of the phrases "a select embodiment," "in one embodiment," or "in an embodiment" in various places throughout this specification are not necessarily referring to the same embodiment.

The illustrated embodiments of the invention will be best understood by reference to the drawings, wherein like parts are designated by like numerals throughout. The following description is intended only by way of example, and simply illustrates certain selected embodiments of devices, systems, and processes that are consistent with the invention as claimed herein.

A temporary electrical fixture, as used herein, is a fixture that can be easily connected and disconnected from a power supply by means of a plug and outlet. A plug used in the connection of a fixture may be in the form of a male connector to be received by a corresponding female connector at the outlet so as to form an electrical junction with which power may pass through to power the fixture. Disconnection of the temporary electrical fixture includes removing the plug out from the outlet. Accordingly, the temporary fixture may be easily and conveniently connected and disconnected from the outlet, and similarly transported across locations.

It is understood that a permanent electrical fixture is a fixture that is wired to an electrical circuit in a manner that is only removable by means of severing the junction between wires. For example, whereby a fixture is permanently installed to a circuit by means of twisting wire ends together, disconnection may include undoing the twisting of the wires or severing the wires. Accordingly, both the connection and disconnection of the permanent fixture encompasses challenges, each requiring temporarily shutting off power to the local circuit electrically wired to the fixture.

Figure 1:
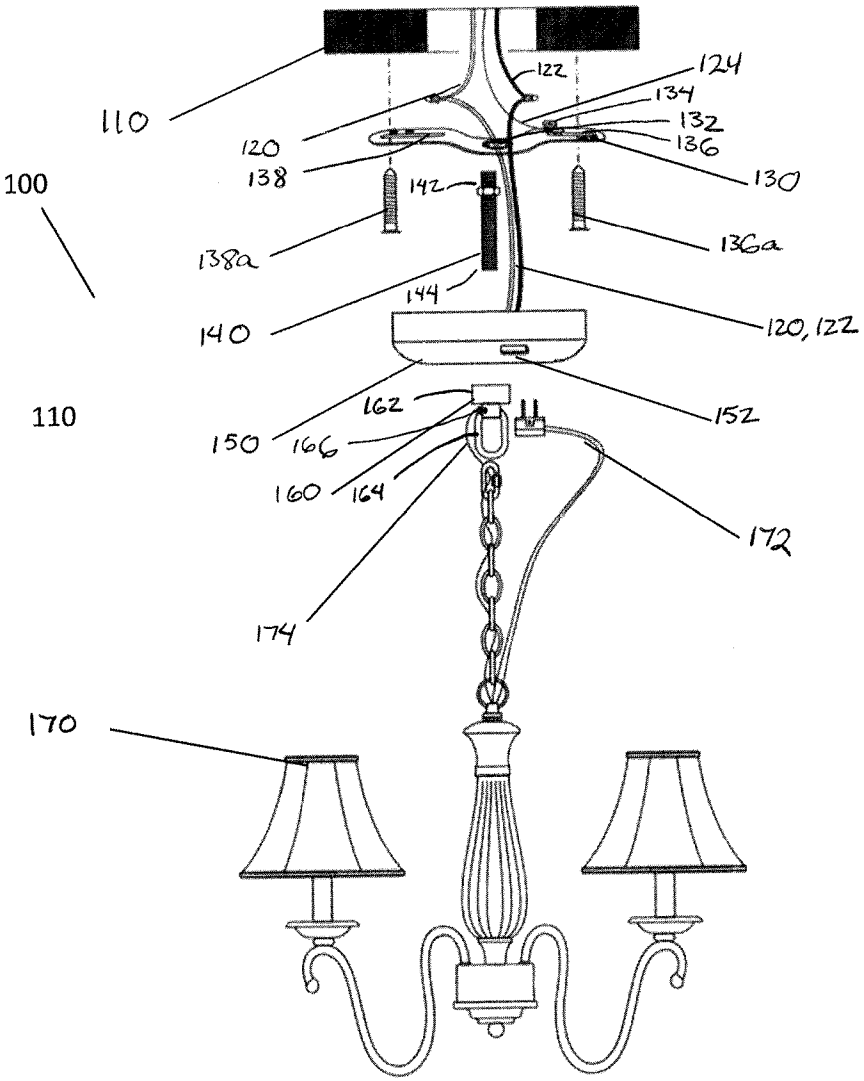
FIG. 1 depicts a diagram illustrating an exploded view of a power fixture assembly.

Referring to FIG. 1, a diagram (100) illustrating an exploded view of a fixture assembly is shown with an outlet (110) having electrical wires (120)-(124) emanating therefrom, where outlet 110 is an electrical outlet. In particular, the electrical wires include power wires (120) and (122) as well as a grounding wire (124). Wires (120) and (122) provide power to the fixture while the grounding wire (124) grounds the electrically powered fixture. A bracket (130) is shown in communication with the wires (120)-(124). Details of the bracket (130) are shown and described in FIG. 2. As shown herein, the bracket (130) has a primary aperture (132), a ground connector (134), and two secondary apertures (136) and (138). The ground connector (134) is shown in receipt of the grounding wire (124) and functions to ground the bracket (130) to the outlet (110). Wires (120) and (122) are shown passing through the primary aperture (132). Secondary fasteners (136*a*) and (138*a*) are shown received in the corresponding secondary apertures (136) and (138) to fasten or attach the bracket (130) to the outlet (110). As depicted in FIG. 1, the fasteners (136*a*) and (138*a*) are bolts, however, fasteners (136*a*) and (138*a*) may be in the form of screws, clips, rivets, or any other form of hardware that is capable of fastening two bodies together.

A support bolt (140) is shown fastened to the bracket (130) through the primary aperture (132). The support bolt (140) may be in the form of a bolt and nut configuration, or in one embodiment, an alternative and comparable fastening element, that is sized and fitted to the bracket (130) on a proximal end (142) of the bolt (140) so as to receive another connection on the distal end (144) of the bolt (140). The wires (120) and (122) are shown extending through the primary aperture (132) and in electrical communication with a base outlet (152) which is integrated within a base enclosure (150). Details of the base outlet (152) and base enclosure (150) are shown and described in details in FIGS. 8-11. A junction knob (160) is shown positioned proximal to the base enclosure (150). Details of the junction knob are shown and described in FIGS. 5, 9, and 10. The junction knob (160) functions an interface between the base enclosure (150) and a fixture (170). In the example shown, the fixture (170) is a chandelier. However, the fixture should not be considered or limited to a chandelier or alternative light fixture. In one embodiment, the fixture can be any power-consuming fixture including, but not limited to, a chandelier, lamp, ceiling fan, or electrically powered device. For example, in one embodiment, the fixture (170) may also be a power consuming electronics such as, but not limited to, a television, monitor, audio speaker, or projector.

As depicted in FIG. 1, the junction knob comprises a junction base (162), a loop (164), and a pin (166). The junction base (162) is configured to fasten to the distal end (144) of the support bolt (140) and the loop (164) is configured to receive the fixture (170). As further shown, the fixture (170) includes a plug (172), a separate grounding wire (174), also referred to herein as a second grounding wire. The plug (172) is configured to be inserted into the base outlet (152) so as to provide electrical power to the fixture (170). The second grounding wire (174) is shown connected to the pin (166), effectively grounding the fixture (170). Accordingly, the junction knob (160) functions as an interface between the enclosure (150) and the fixture (170) to mechanically and electrically attach the fixture.

Figure 2:
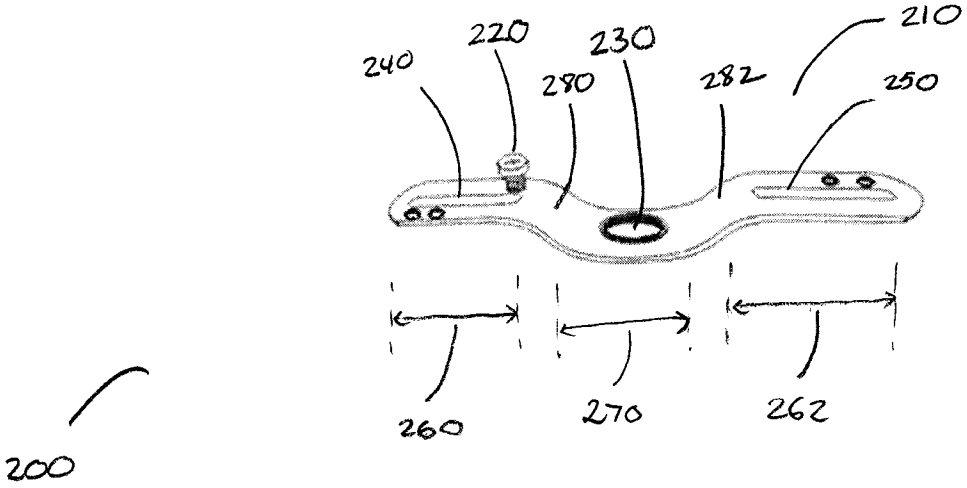
FIG. 2 depicts a perspective view of a bracket.

Referring to FIG. 2, a perspective view (200) of the bracket (130) is illustrated. The bracket (210) includes three apertures, including a central aperture (230), also referred to as a primary aperture, and two secondary apertures (240) and (250). The bracket (210) is shown with an elongated body with the primary aperture (230) centrally positioned. The two secondary apertures (240) and (250) are shown positioned on opposite sides of the primary aperture (230). The secondary apertures (240) and (250) are each configured to receive separate fasteners necessary to secure the bracket (210) to the outlet (110). A grounding connector (220) is positioned adjacent to one of the secondary apertures (240), and is configured to receive the grounding wire (124) shown in FIG. 1. The primary aperture (230) is configured to receive the support bolt (140). As further shown, the bracket (210) has a concave or relatively concave profile, with two planar regions, including two raised planar regions (260) and (262) a lowered planar region (270). A first connection region (280) joins planar region (260) with the lowered planar region (270), and a second connection region (282) joins planar region (262) with the lowered planar region (270). In one embodiment, and as shown herein, the connections regions (280) and (282) are rounded or curved, but the geometric profile of the regions (280) and (282) should not be considered limiting. Similarly, the geometric properties of the bracket (210), including regions (260), (262), and (270), together with regions (280) and (282) should not be considered limiting, and in one embodiment may be rearranged with the same or different geometric properties. Accordingly, the bracket functions as an interface between the outlet (110) and the base enclosure (150).

Figure 3:
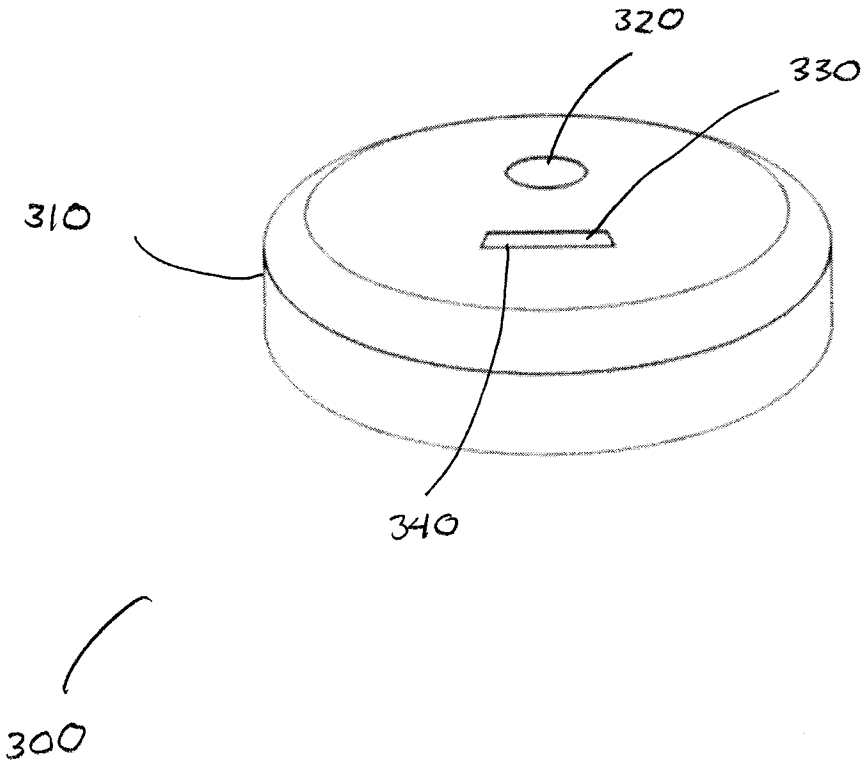
FIG. 3 depicts a bottom perspective view of a base enclosure.

Referring to FIG. 3, a bottom perspective view (300) of the base enclosure is illustrated. The base enclosure (310) is configured with two openings, including a first aperture (320) and a second aperture (330). The first aperture (320) is sized to receive the bolt (140), also referred to herein as a support bolt. In one embodiment, the support bolt (140) is received by and passes through the first aperture (320). The second aperture (330) is sized to receive the base outlet (152) (not shown). In one embodiment, the base outlet (152) is integrated with the base enclosure (310). Similarly, in one embodiment, the base outlet (152) is flush or relatively flush with the exterior wall (340) of the base enclosure.

Figure 4:
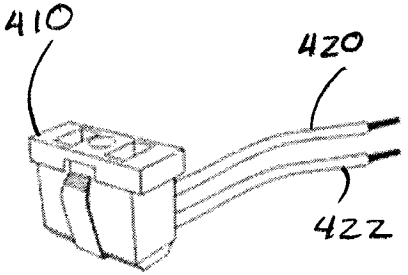
FIG. 4 depicts a perspective view of a base outlet.

As shown and described in FIGS. 1 and 3, the base outlet is integrated with the base enclosure (310) to provide an electrical outlet for the fixture proximal to the secondary surface to which the fixture is attached. Referring to FIG. 4, a perspective view (400) of the base outlet (410) is shown. The base outlet (410) is configured to receive a plug from the fixture to be installed. The base outlet (410) is shown with wires (420) and (422) to be electrically connected with the electrical wires (120) and (122) from the outlet (110), thereby transferring electrical power from the outlet to the base outlet (410). In one embodiment, when the base outlet (410) is integrated with the base enclosure (310), the base outlet (410) is received in the second aperture (330) and is flush or relatively flush with the exterior wall (340) of the base enclosure (310). In one embodiment, the second (330) becomes non-visible or non-apparent when the base outlet (410) is received and integrated with the base enclosure (310). Accordingly, the position of the base outlet (410) relative to the base enclosure (310) maintains a low profile so as to be aesthetically pleasing as well as non-intrusive.

Figure 5:
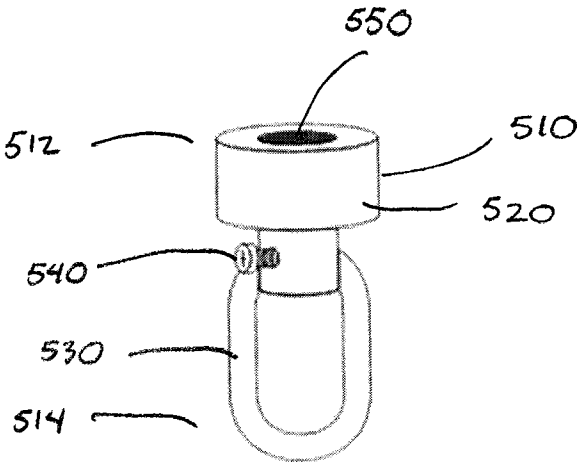
FIG. 5 depicts a perspective view of a junction knob.

Referring to FIG. 5, a perspective view (500) of the junction knob (510) is depicted. The junction knob (510) serves as a connection interface between the fixture (170) and the base enclosure (150). In the embodiment shown in FIG. 5, the junction knob (510) has a rounded body (520), although this body profile should not be considered limiting. The junction knob (510) is shown with a proximal end (512) and a distal end (514). The proximal end (512) is shown with an aperture (550) is configured to receive the support bolt (140), and more specifically, the distal end (144) of the support bolt (140). A pin (540) is shown positioned between the proximal and distal ends (512) and (514), respectively. The pin (540) provides an attachment point to receive the grounding wire from the fixture. The distal end (512) is shown with an attached chain loop (530), also referred to herein as a fixture receiver. As shown in FIG. 1, the fixture (170) is in mechanical communication with the fixture support assembly via the receiver (530). In one preferred embodiment, the aperture (550) and receiver (530) are aligned so that when the fixture (170) is received by the receiver (530), the weight of the fixture (170) is directed linearly. Accordingly, the junction knob (510) functions as a mechanical and electrical interface between the fixture (170) and the base enclosure (150).

Figure 6:
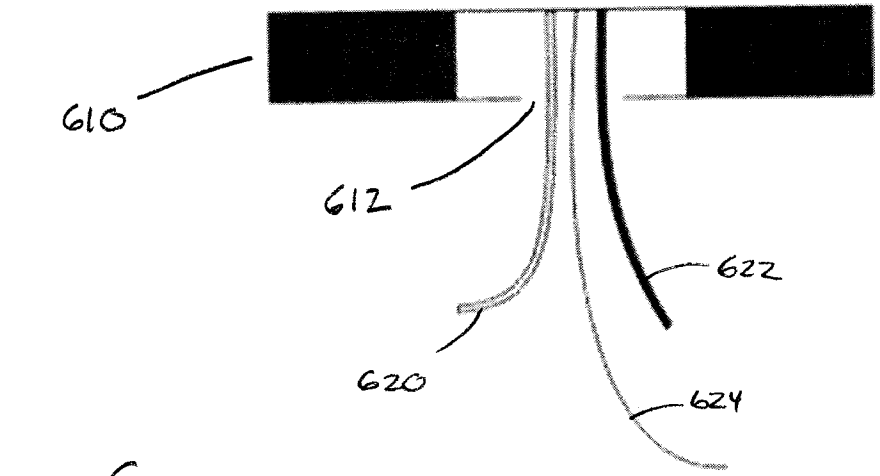
FIG. 6 depicts a front sectional view of an outlet.

Referring to FIG. 6, a front sectional view (600) of the outlet is depicted. As shown, the outlet (610) has an aperture (612) from which wires (620)-(624) pass through. Wires (620) and (622) are collectively referred to herein as "electrical wires" and, in combination, provide electrical power to attached fixture (170). In one embodiment, wire (620) has one voltage polarity and wire (622) has a second voltage polarity, different from the polarity of wire (620). Wire (624) is referred to herein as a grounding wire and functions to ground the fixture (170) to be attached to the support assembly. Grounding wire (624) is attached to the ground connector (134) of the bracket (130).

Figure 7:
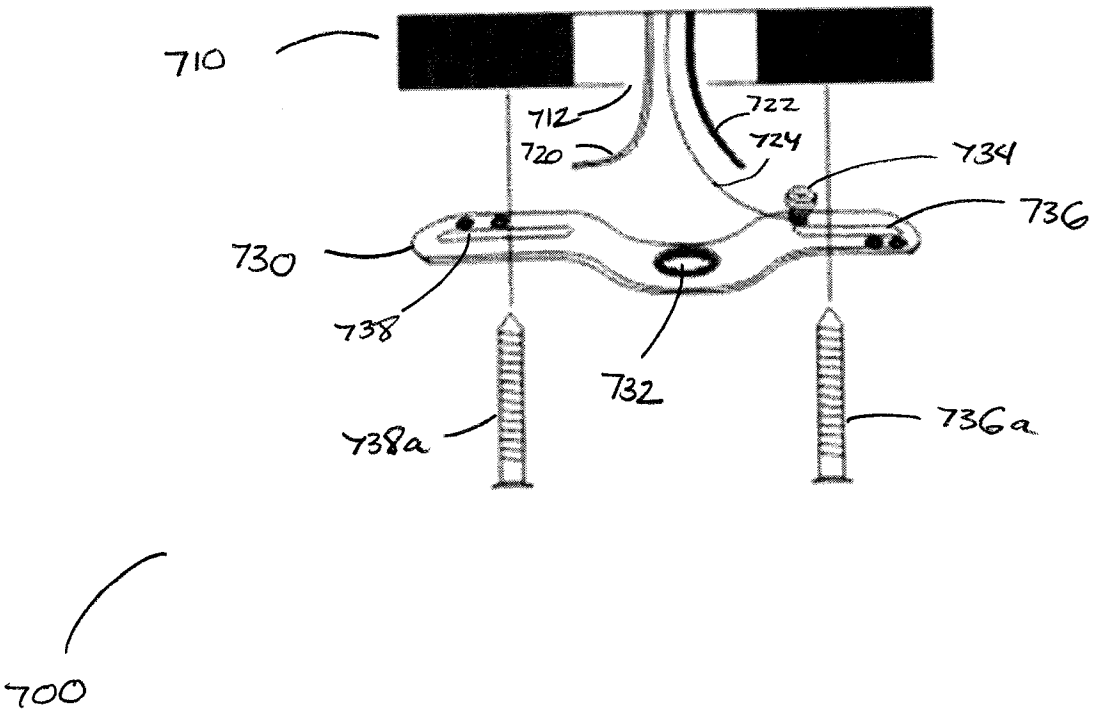
FIG. 7 depicts a front sectional view demonstrating bracket installation to the outlet.

FIGS. 7-11 collectively illustrate steps of assembling select components of the base and installing the fixture together with the base. Referring to FIG. 7, a front sectional view (700) is provided demonstrating bracket installation to the outlet. The outlet (710) has an aperture (712) from which wires (720), (722), and (724) pass through. As shown and described in FIG. 6, wires (720) and (722) provide electrical power to the attached fixture (170), and wire (724) is a grounding wire. Bracket (730) is presented and the grounding wire (724) is connected to the grounding connector (734) thereby grounding the bracket (730) to the outlet (710). The bracket (730) is fastened to the outlet (710). Specifically, in the embodiment depicted in diagram (700), the bracket (730) is has two oppositely positioned secondary apertures (736) and (738) each configured to receive a mechanical fastening device (736*a*) and (738*b*), respectively. As shown herein, the fastening devices (736) and (738) are shown as screws, but any form of a fastener may be used to attached or secure the bracket (730) to the outlet (710). Similarly, the secondary apertures (736) and (738) are shown depicted as slots or elongated, but the size and shape of the apertures (736) and (738) should not be considered limiting. The bracket (730) is also configured with a primary aperture (732) to receive the support bolt (140).

Figure 8:
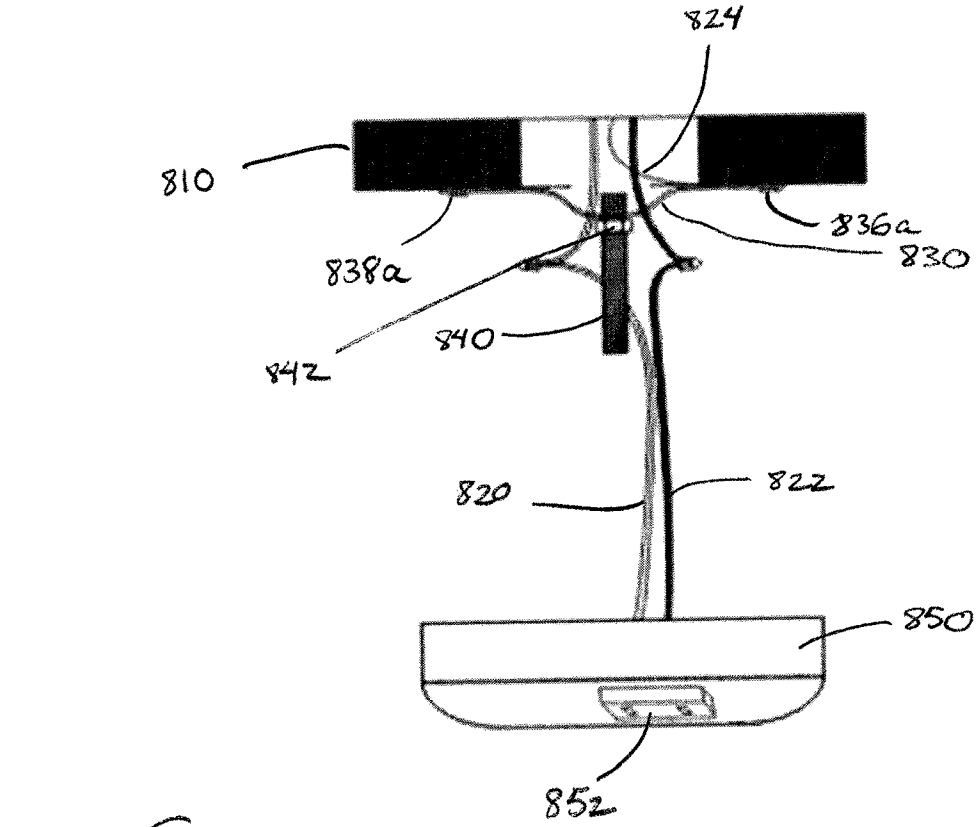
FIG. 8 depicts a front sectional view illustrating a support bolt, the base enclosure and the base outlet, and installation of the illustrated components to the outlet.

Referring to FIG. 8, a front sectional view (800) is provided illustrating a support bolt, the base enclosure and the base outlet, and installation of the illustrated components to the outlet. As shown in the illustrated position of the components, the bracket (830) is attached to the outlet (810) via fasteners (836*a*) and (838*a*) shown flush with the outlet (810). The bracket (830) is electrically grounded via the grounding wire (824) secured to the grounding connector (not shown) of the bracket (830). In addition, the support bolt (840) is shown fastened to the bracket (830). In the embodiment shown, the support bolt (840) has a nut (842) that secures the support bolt (840) in place with respect to the bracket (830). The base outlet (852) is shown integrated into the base enclosure (850) with the electrical wires (820) and (822) shown in electrical communication with a base outlet (852), effectively transforming the base enclosure (850) into a power junction container or enclosure. Accordingly, as shown in this portion of the assembly, the outlet (810) is in mechanical and communication with both the base enclosure (850) and electrical communication with the base outlet (852).

Figure 9:
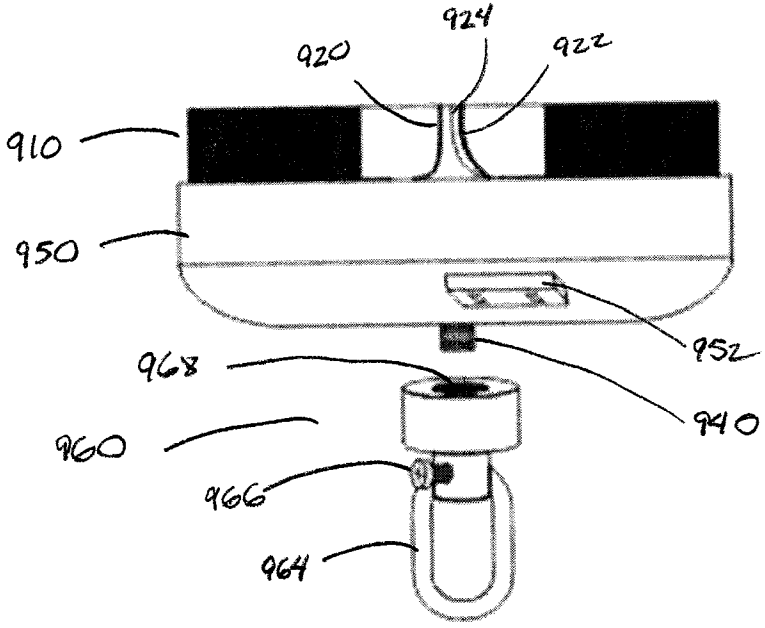
FIG. 9 depicts a front sectional view illustrating installation if the junction knob to a base assembly.

Referring to FIG. 9, a front sectional view (900) is provided illustrating installation if the junction knob (860) to a base assembly. As shown, the base enclosure (950) is positioned proximal to the outlet (910) via the mechanical and electrical connections shown and described in FIG. 8. In one embodiment, the base over (950) may be positioned to enclose the outlet (910) so that the outlet (910) and the associated wires (920)-(924) are not visible. Similarly, in one embodiment, the outlet (910) is positioned internal to a wall and once the base enclosure (950) is secured to the outlet (910), the outlet (910) is not visible. Accordingly, once the base enclosure (950) is positioned or secured to the outlet (910), the only visible elements are the base enclosure (950), the base outlet (952), and a portion of the support bolt (940).

As further shown, a junction knob (960) is positioned proximal to the base enclosure (950), and has a threaded opening (968) sized to be received by the support bolt (940). After the junction knob (950) is fastened to the support bolt (940), the base enclosure (950) is secured to the junction knob (960), with the junction knob (960) covering the g the support bolt (940) so that the support bolt (940) is not visible. As shown, the junction knob (960) is configured with a pin (966) positioned on an external surface of the body of the junction knob (960). The pin (966) is configured to receive the grounding wire (174) from a fixture (170). A loop (964) is shown secured to the junction knob (960) distal from the threaded opening (968). As shown and described in FIGS. 1 and 11, the loop (964) is configured to mechanically receive the fixture (170). Due to the fact that the support bolt (940) is fastened to the bracket (130), which is electrically connected to the grounding wire (924), the support bolt (940) is electrically grounded as well as the junction knob (960) that is fastened thereto. Also, due to the electrical connection between the base outlet (952) and the electrical wires (920) and (922), the base outlet (952) receives electrical power. Accordingly, an electrical apparatus in electrical communication with the pin (966) will be grounded and any item connected to the base outlet (952) will receive electrical power.

Figure 10:
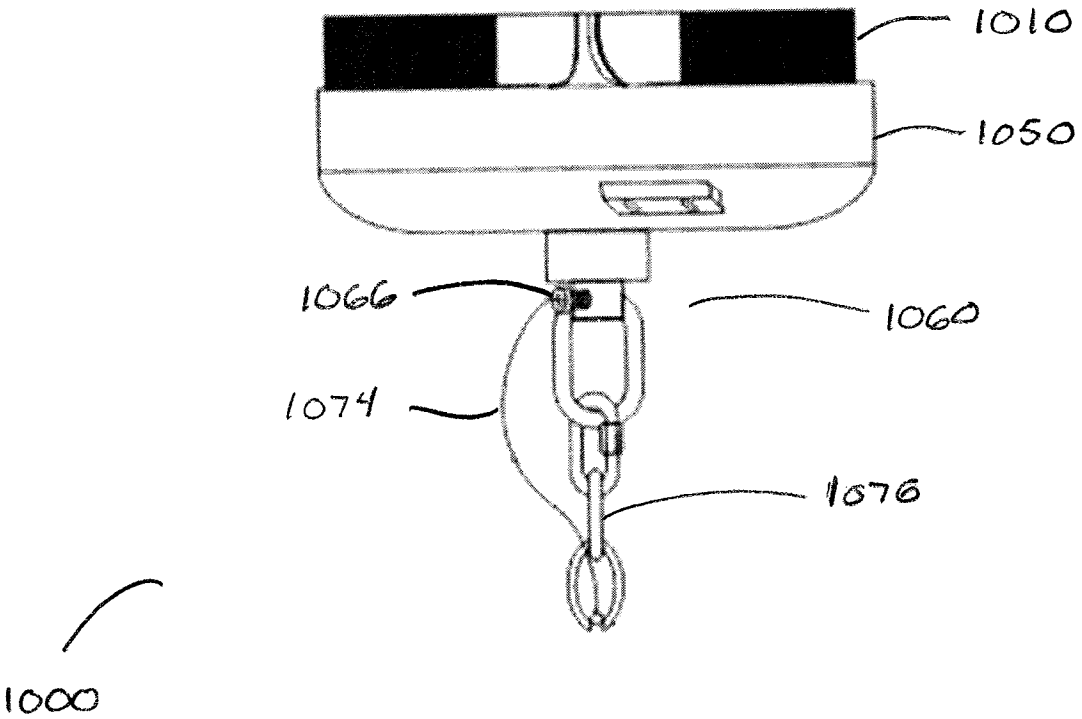
FIG. 10 depicts a front sectional view illustrating installation of a chain to the junction knob and the base assembly.

Referring to FIG. 10, a front sectional view (1000) illustrating installation of a chain (1080) to the junction knob (1060) is shown. As shown in FIG. 9, which is a prior step in installation of the fixture (not shown), the junction knob (1060) has been fastened to the support bolt (140) thereby securing the base enclosure (1050) to the outlet (1010). In the depicted embodiment, a chain (1076) and a grounding wire (1074) from the fixture (not shown) are in communication with the junction knob (1060). More specifically, the grounding wire (1074) is a part of the fixture (not shown) and is electrically secured pin (1066) to ground the fixture (not shown), and the chain (1076) is mechanically attached to the junction knob (1060). Accordingly, the apparatus in mechanically and electrical communication with the outlet (1010) is shown herein to be electrically and mechanically positioned to receive the fixture.

Figure 11:
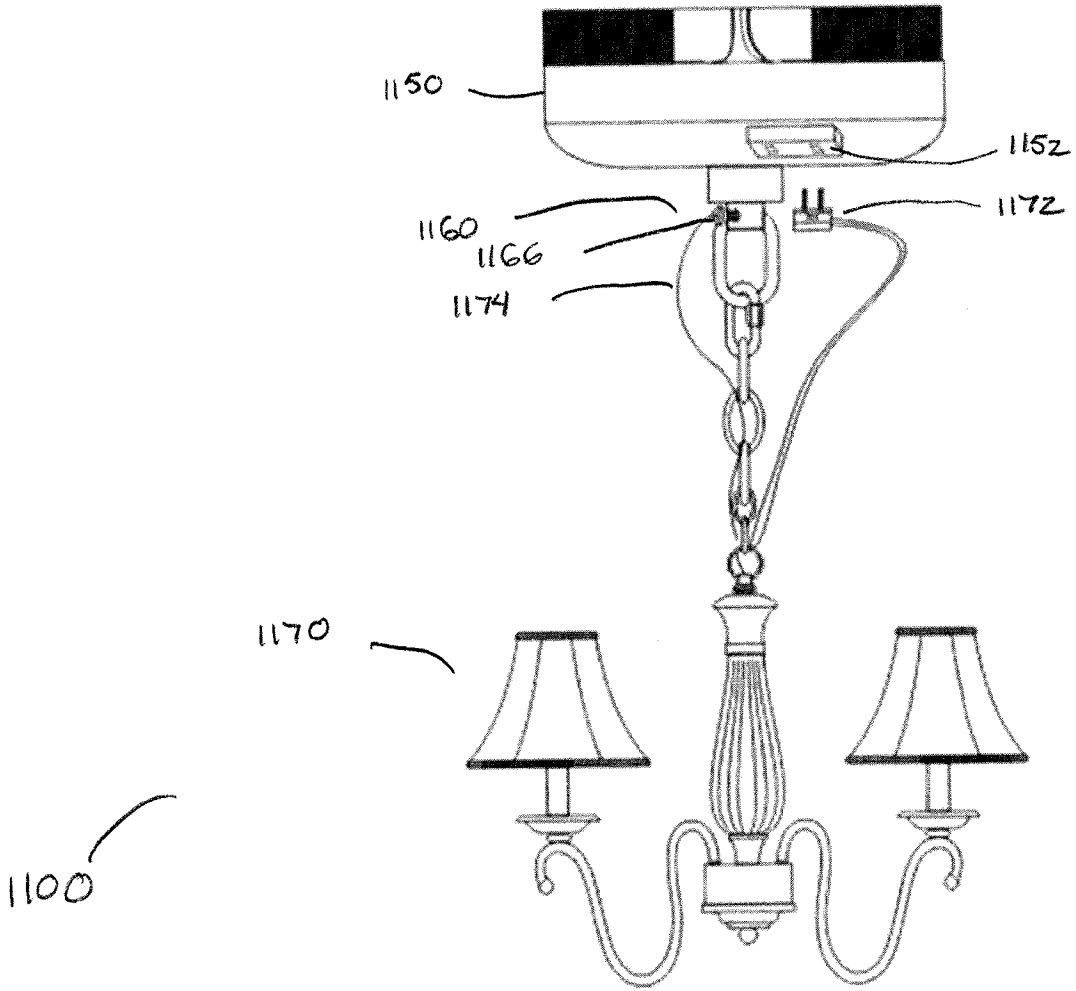
FIG. 11 depicts a front sectional view illustrating an assembly of an embodiment of the power fixture to the base assembly.

Referring to FIG. 11, a front sectional view (1100) illustrating an assembly of an embodiment of the fixture to the base assembly is shown. As shown herein, the fixture (1170) is physically attached to the junction knob (1160). The grounding wire (1174) from the fixture (1170) is in electrical communication with the pin (1166) of the junction knob (1160). The fixture (1170) is shown with a plug (1172) being received by the base outlet (1152). In one embodiment, the fixture (1170) may come with a power cord in the form of a cable configured to be hard wired into the outlet (1110), and as such the fixture cable is transformed with an integrated plug, as shown and described in FIG. 12. As shown herein, the base outlet (1152) is integrated with the base enclosure (1150), which effectively encloses the electrical components of the outlet (1110). Accordingly, based on the transformation of the base enclosure enables the power junction container to mechanically secure the fixture and electrically receive the fixture plug in the integrated base outlet.

Figure 12:
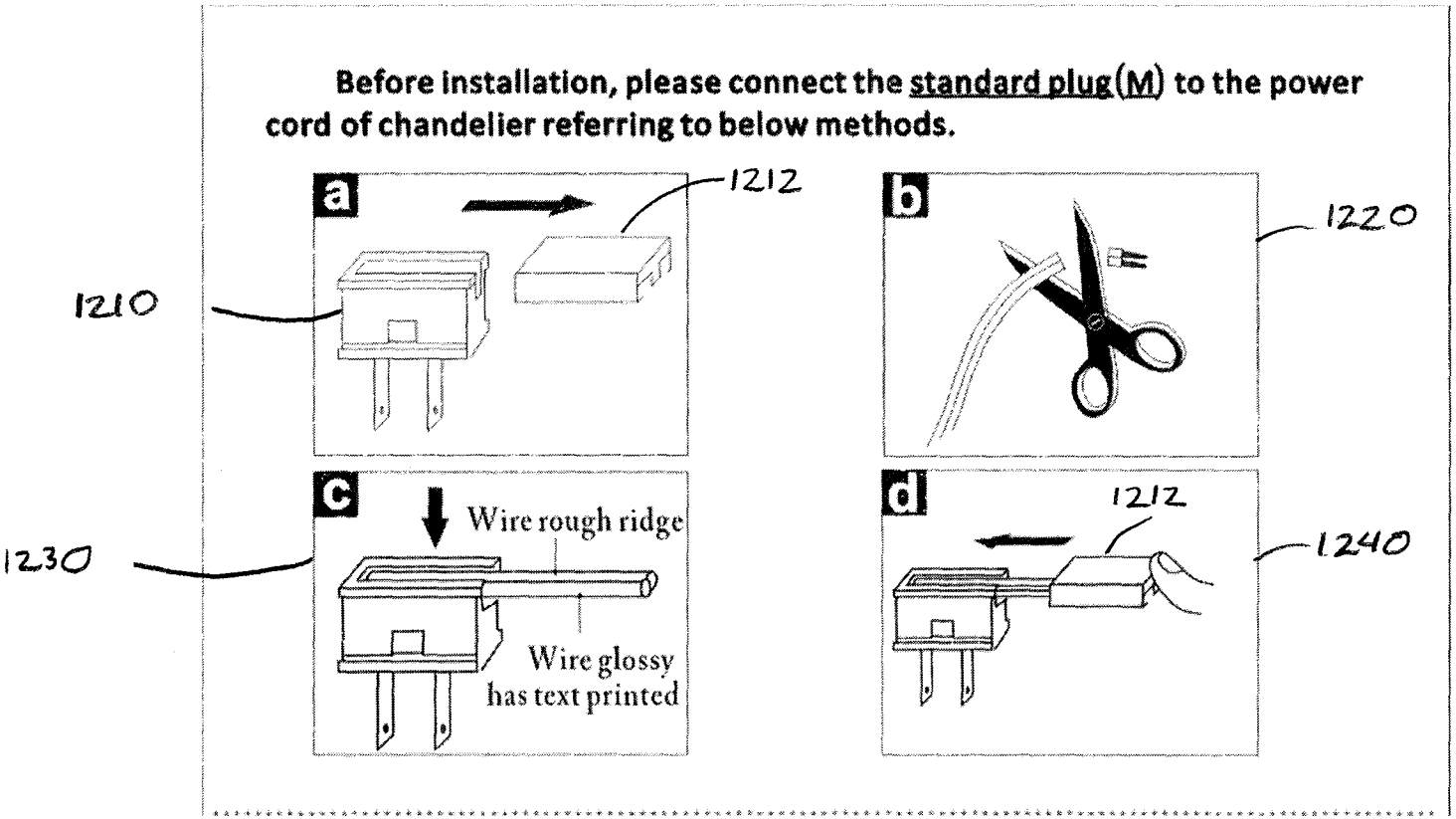
FIG. 12 depicts a process of converting a cable to a plug.

Referring to FIG. 12, a diagram (1200) illustrating a process of converting a cable to a plug. As described in FIG. 11, the fixture may be configured with a power cord in the form of a cable without a plug to be received by the outlet. In this situation, the plug body (1210) is provided with a plug cover (1212). The fixture cable is severed to reveal the wires that comprise the cable (1220). The wires are electrically and appropriately connected to plug body (1230). Thereafter, the plug cover (1212) is secured to the plug body (1240) to enclose the wires and protect them from damage. Accordingly, the process shown herein converts the cable or otherwise attached a plug to the cable to enable the plug to be received by a standard electrical outlet, such as the integrated base outlet.

Figure 13:
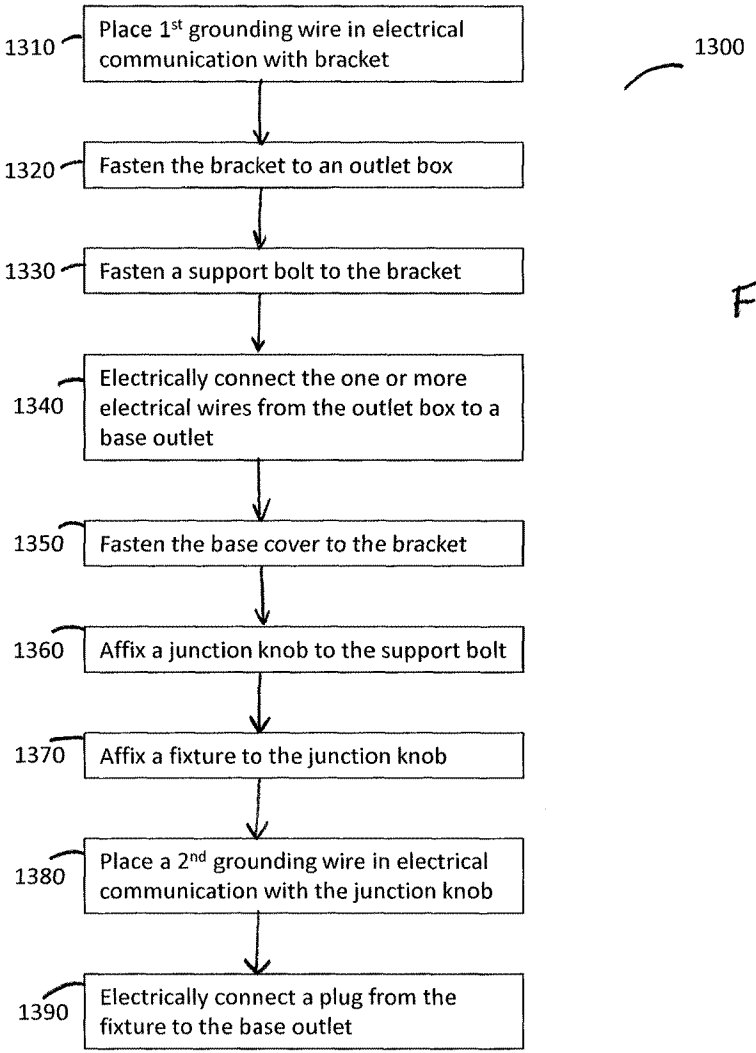
FIG. 13 depicts a flow chart of installation of the base assembly and the power fixture.

FIGS. 1-11 are mechanical illustrating of the physical and electrical components of the apparatus, and include a physical process of both mechanical and physical installation of the fixture. Referring to FIG. 13, a flow chart (1300) is provided illustrating the procedure for installing the base and the fixture. As shown, a first grounding wire emanating from the outlet is grounded to a bracket (1310). Following the electrical communication at step (1310), the bracket is fastened or otherwise mechanically attached to the outlet (1320). In one embodiment, electrical wires from the outlet extended through the central aperture in the bracket as shown in FIG. 8. A support bolt is then fastened to the bracket (1330) through the central aperture, and the electrical wires of the outlet are electrically connected to a base outlet which is integrated into the base enclosure (1340). The base enclosure is then fastened to the bracket (1350), and as shown in FIG. 7. A junction knob is affixed to the support bolt (1360), as shown in FIG. 9. Once the junction knob is attached, the fixture is mechanically attached to the junction knob (1370) via the loop, as shown in FIG. 9. A second grounding wire, from the fixture, is then secured to the pin (966) of the junction knob (1380) to ground the fixture, following by a plug from the fixture being placed into and received by the base outlet (1390). Steps (1310)-(1390) demonstrates assembly of a fixture to a base enclosure that has been transformed to a power junction container. Accordingly, as demonstrated, the process shown herein supports both mechanical and electrical installation of the fixture.

Figure 14:
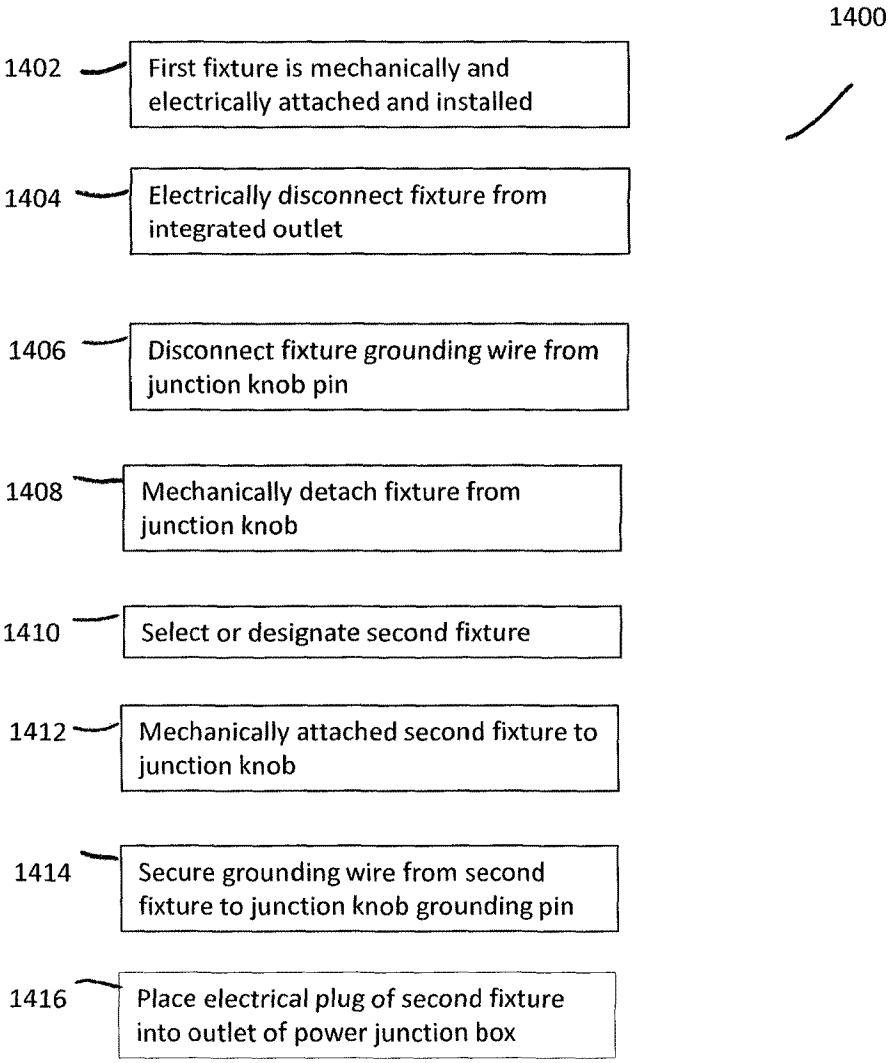
FIG. 14 depicts a flow chart illustrating a process for replacement of the power fixture.

It is understood that the fixture may need to be replaced for various reasons. For example, the fixture may fail, or in one embodiment, the fixture may be selectively replaced. Referring to FIG. 14, a flow chart (1400) is provided to demonstrate a process for replacement of the fixture. As shown, the fixture, also referred to herein as a first fixture, is electrically and mechanically attached to the power junction container and is installed (1402). Removal of the first fixture requires both an electrical and a mechanical disconnection. First, the fixture plug is removal from the outlet of the power junction container, also referred to herein as the integrated outlet of the base enclosure, (1404). Thereafter, the fixture grounding wire is disconnected from the pin of the junction knob (1406). Completion of steps (1404)-(1406) electrically disconnects the first fixture. Thereafter, the fixture is mechanically detached from the junction knob (1408). In one embodiment, the fixture loop may be mechanically disconnected from the loop of the junction knob. Completion of step (1408) is completion of the mechanical disconnection of the fixture from the power junction container.

Following step (1408), the power junction container is available to receive a second fixture. A second fixture is selected or designated (1410). The second fixture is mechanically attached to the junction knob (1412). Thereafter, a ground wire from the second fixture is attached or secured to the pin, e.g. grounding pin, of the junction knob (1414), following by the electrical plug of the fixture being placed into the outlet of the power junction container (1416). Although the steps shown herein demonstrated a mechanical connection of the second fixture prior to the electrical connection, in one embodiment, the steps may be reversed. Accordingly, as shown, the replacement process enables the power junction container to facilitate the electrical connection and disconnection of the fixture.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated. The implementation of the base enclosure with an integrated outlet facilitates installation of the fixture. Namely, the base enclosure is transformed into a power junction container that is separate from the fixture. Accordingly, the transformation of the base enclosure as shown and described in FIGS. 1-12, provides electrical power and structural support for the fixture, thereby facilitating the assembly or exchange of an electrically powered fixture.

It will be appreciated that, although specific embodiments of the invention have been described herein for purposes of illustration, various modifications may be made without departing from the spirit and scope of the invention. In particular, the electrical outlet that transforms the base enclosure into a power junction container may be configured to blend with the ornamentation of the base enclosure thereby mitigating visibility of the electrical assembly. Similarly, the base enclosure may be configured to receive a variety of different powered fixtures or non-powered fixtures so as to diversify the utility of the base. For example, the junction knob with the loop may mechanically receive or replace a fixture that is secured via a mechanical loop attachment, with the electrical connection being optional. Similarly, in one embodiment, the loop of the junction knob may employ an alternative mechanical fastening element to receive a variety of different fixtures. For example, in one embodiment, the loop may be replaced with a clip, a screw, etc. or a receiver for a clip or a screw, etc. Accordingly, the scope of protection of this invention is limited only by the following claims and their equivalents.

What is claimed is:

1. A method of assembling an electrical system comprising:

converting a base enclosure into a power junction container comprising electrically connecting the base enclosure to an electrical outlet defined by a fixed surface, including attaching a wire from the electrical outlet to a base outlet of the power junction container and creating an integrated outlet;

the power junction container includes a first side facing the fixed surface and an oppositely disposed second side, positioning the first side of the power junction container flush with the fixed surface, and the second side positioned orthogonally spaced apart from the fixed surface and distal from the first side;

mechanically attaching a fixture to the power junction container; and electrically connecting a fixture plug to the integrated outlet of the power junction container, wherein the integrated outlet is positioned on the second side of the power junction container, the second side including a first external surface having unobstructed access to the fixture plug and the integrated outlet when the electrical system is fully assembled, the second side further including a first aperture and a second aperture, the power junction container further including at least one wall extending between the first side and the second side, the at least one wall, the first side, and the second side defining a container cavity, the first aperture and the second aperture in communication with the container cavity, wherein the first aperture and the container cavity are adapted to receive a mechanical support element, and the second aperture and the container cavity are adapted to receive the integrated outlet and the wire.

2. The method of claim 1, further comprising removing the fixture from the power junction container, including:

electrically disconnecting the fixture plug from the base outlet;

disconnecting a grounding of the fixture from the junction; and mechanically disconnecting the fixture from the junction.

3. The method of claim 2, further comprising replacing the fixture, including mechanically and electrically attaching a second fixture to the junction, wherein the electrical attachment includes grounding the second fixture to the junction.

4. The method of claim 1, wherein electrically connecting the fixture plug comprises electrically coupling the fixture plug to a power cable, the fixture plug configured to be received by the integrated outlet.

5. The method of claim 1, wherein converting the base enclosure to the power junction container further comprises electrically connecting one or more electrical wires from the electrical outlet to the base outlet attached to the base enclosure.

6. The method of claim 5, wherein the base outlet is integrated into the base enclosure.

7. The method of claim 5, further comprising:

coupling a first grounding wire from the electrical outlet to a bracket;

coupling the mechanical support element to the bracket;

coupling a second grounding wire from the fixture to the mechanical support element through an interface, the bracket and the mechanical support element functioning as a mechanical support mechanism and an electrical grounding junction between the electrical outlet and the base enclosure; and at least partially extending the mechanical support element through the first aperture and the container cavity.

8. The method of claim 3, wherein the fixture is a light fixture.

9. A system comprising:

a base enclosure converted into a power junction container through an electrical connection of the base enclosure to an electrical outlet defined by a fixed surface, the power junction container including a grounding wire from an outlet grounded to a bracket embedded in the power junction container, and an attachment of a power wire from the electrical outlet to a base outlet of the power junction container, wherein the power wire attachment creates an integrated outlet, wherein the power junction container includes a first side facing the fixed surface and an oppositely disposed second side, the first side of the power junction container flush with the fixed surface, and the second side positioned orthogonally spaced apart from the fixed surface and distal from the first side;

a fixture mechanically attached to the power junction container; and the fixture electrically attached to the power junction container, including a fixture grounding wire grounded to a junction in communication with the power junction container and a fixture plug electrically connected to the integrated outlet, wherein the integrated outlet is positioned on the second side of the power junction container, the second side including an external surface having unobstructed access to the fixture plug and the integrated outlet when the system is fully assembled, the second side further including a first aperture and a second aperture, the power junction container further including at least one wall extending between the first side and the second side, the at least one wall, the first side, and the second side defining a container cavity, the first aperture and the second aperture in communication with the container cavity, wherein the first aperture and the container cavity are adapted to receive a mechanical support element, and the second aperture and the container cavity are adapted to receive the integrated outlet and the power wire.

10. The system of claim 9, further comprising a removal of the fixture from the power junction container, including:

an electrical disconnection of the plug from the integrated outlet;

an electrical disconnection of the ground from the junction; and a mechanical disconnection of the fixture from the power junction container.

11. The system of claim 10, further comprising a replacement of the fixture with a second fixture, including a mechanical and electrical attachment of the second fixture to the power junction container, wherein the electrical attachment includes securing a second grounding wire of the second fixture to the junction.

12. The system of claim 9, wherein the electrical connection of the fixture further comprises a coupling of the fixture plug to a power cable, the fixture plug configured to be received by the integrated outlet.

13. The system of claim 9, wherein conversion of the base enclosure to the power junction container further comprises an electrical connection of a plurality of power wires from the electrical outlet to the base outlet attached to the base enclosure.

14. The system of claim 13, wherein the base outlet is integrated into the base enclosure.

15. The system of claim 11, wherein the fixture is a light fixture.

16. A method for converting a permanent electrical fixture system to a temporary electrical fixture system comprising:

providing a permanent electrical fixture system including a permanent electrical outlet defined by a fixed surface, an outlet wire extending from the permanent electrical outlet, and a permanent electrical fixture including a fixture cable, the fixture cable electrically coupled to the outlet wire, the permanent electrical fixture mechanically coupled to at least one of the permanent electrical outlet and a support structure proximate to the permanent electrical outlet;

electrically disconnecting the fixture cable from the outlet wire;

mechanically disconnecting and removing the permanent electrical fixture from the permanent electrical outlet and the support structure;

creating an integrated outlet, including electrically coupling a base outlet of a power junction container to the outlet wire, wherein the integrated outlet is unobstructed when the temporary electrical fixture system is fully assembled, the integrated outlet configured to receive a fixture plug;

converting a base enclosure into a power junction container comprising electrically connecting the base enclosure to the permanent electrical outlet;

the power junction container includes a first side facing the fixed surface and an oppositely disposed second side, positioning the first side of the power junction container flush with the fixed surface, the second side positioned orthogonally spaced apart from the fixed surface and distal from the first side, the second side further including a first aperture and a second aperture, the power junction container further including at least one wall extending between the first side and the second side, the at least one wall, the first side, and the second side defining a container cavity, the first aperture and the second aperture in communication with the container cavity, wherein the first aperture and the container cavity are adapted to receive at least a portion of the support structure, and the second aperture and the container cavity are adapted to receive the integrated outlet and the outlet wire;

mechanically coupling the power junction container to one of the permanent electrical outlet and the support structure;

converting the permanent electrical fixture to a temporary electrical fixture comprising coupling a fixture plug to the fixture cable;

mechanically coupling the temporary electrical fixture to the power junction container; and inserting the fixture plug into the integrated outlet.

17. The method of claim 16, further comprising forming a fixture grounding system comprising:

providing at least one outlet grounding wire with the outlet wire;

coupling the outlet grounding wire to a fixture support device, the fixture support device including at least one electrically conducting material;

coupling the support structure to the fixture support device, the support structure including at least one electrically conducting material;

extending at least one fixture grounding wire from a portion of the temporary electrical fixture to a fixture coupling device, the fixture coupling device including at least one electrically conducting material;

at least partially extending the support structure through the first aperture and the container cavity; and coupling the fixture coupling device to the support structure.

18. The method of claim 16, wherein electrically coupling a base outlet of a power junction container to the outlet wire comprises:

providing the base enclosure including an exterior wall and the first aperture and second aperture defined within the exterior wall;

integrating the base outlet into the base enclosure, comprising installing the base outlet in one of the second aperture such that the base outlet is flush with the exterior wall and provides unobstructed access for inserting the fixture plug into the base outlet, the base outlet including a base outlet wire; and coupling the base outlet wire to the outlet wire.

19. The method of claim 16, wherein mechanically coupling the power junction container to one of the permanent electrical outlet and the support structure comprises:

providing a bracket and the support structure, the bracket including at least one bracket aperture to receive the support structure;

providing the base enclosure including an exterior wall and the first aperture defined within the exterior wall;

providing a junction knob including a junction knob aperture to receive the support structure;

coupling the bracket to the fixed surface;

coupling the support structure to the bracket through the bracket aperture;

inserting the base enclosure onto the support structure through one of the first aperture; and securing the base enclosure to the support structure, including coupling the junction knob to the mechanical support through the junction knob aperture.

20. The method of claim 1, wherein the electrical system is fully assembled when:

the integrated outlet of the power junction container is electrically connected to the electrical outlet;

the power junction container is mechanically coupled to the support structure proximate to the electrical outlet; and the fixture is mechanically coupled to the power junction container.

* * * * *